United States Patent [19]

Heimendinger

[11] Patent Number: 5,014,902

[45] Date of Patent: May 14, 1991

[54] METHOD OF MANUFACTURING A SUPPORT PANEL FORMING A DISPLAY UNIT AND PANEL OBTAINED BY THIS METHOD

[75] Inventor: Bernard Heimendinger, Montmorency, France

[73] Assignee: Fapec, France

[21] Appl. No.: 386,091

[22] Filed: Jul. 28, 1989

[30] Foreign Application Priority Data

Jul. 29, 1988 [FR] France ..... 88 10247

[51] Int. Cl.[5] ..... B23K 31/02

[52] U.S. Cl. ..... 228/170; 228/173.6; 52/588

[58] Field of Search ..... 52/588, 38; 228/182, 228/173.6, 170; 211/87, 90, 189, 186–187; 248/222.2

[56] References Cited

U.S. PATENT DOCUMENTS

| | | | |
|---|---|---|---|
| 3,841,776 | 10/1974 | Klaus | 52/588 |
| 4,450,970 | 5/1984 | Shepherd | 211/90 |
| 4,607,753 | 8/1986 | Radek | 211/87 |
| 4,618,181 | 10/1986 | Tokuda et al. | 228/173.6 |

*Primary Examiner*—Kenneth J. Ramsey
*Attorney, Agent, or Firm*—William A. Drucker

[57] ABSTRACT

A method of manufacturing a support panel forming a display unit and a panel obtained by means of this method, comprising strips (1) made from metal sheet, which are individually subjected to successive forming operations so as to give them a profile whereby, in the transverse direction along the length of the strips, ends (4, 5) are disposed substantially in the same plane and are separated from each other by an intermediate projecting portion which is connected to one of the ends by an S portion. To form the panel, one end (5) of a strip (1) is applied, over the whole of its length, against the opposite end (4) of the preceding strip (1) and is spot welded.

9 Claims, 4 Drawing Sheets

METHOD OF MANUFACTURING A SUPPORT PANEL FORMING A DISPLAY UNIT AND PANEL OBTAINED BY THIS METHOD

The present invention relates to a panel which can be used for fastening and displaying objects and, more particularly, such a panel formed of a succession of horizontal elements defining therebetween grooves in which elements in the form of hooks may be engaged serving for example for hanging objects to be displayed or else which are integrated in shelves.

Such panels are known which are made from wood, in particular fibreboard, a material which is chosen because it is easily workable using traditional woodworking tools. These panels are of reduced cost, but they have the drawback of not having an agreeable appearance, for they age badly and become soiled and have loading limits. It is moreover a question of artisanal constructions, made to measure.

Panels are also known made from extruded aluminium or extruded wood with a plastic profiled element, which give satisfaction from the appearance point of view but less in so far as the loading strength is concerned, in particular for wooden panels.

However, because of the cost of their component materials, these panels are of a high cost price which adversely affects their development, in particular for the equipment of large exhibition areas.

The object of the present invention is to overcome the above drawbacks of known display panels and for this proposes a display panel which, while being simple to manufacture and of a low cost price, has excellent load strength and has an irreproachable appearance.

According to the invention, for constructing the display panels, a strong and inexpensive material is used formed of metal sheeting which is worked using a particularly original operating method. In fact, according to the method of the invention, the metal sheet is cut up into identical strips whose length corresponds to the length of the panel to be obtained, each metal sheet strip thus obtained is subjected to successive forming operations so as to give it a profile such that it has, transversely, ends disposed substantially in the same plane and which are separated from each other by an intermediate projecting portion connected to one of the ends of the strip by an S profile portion, then the strips thus formed are assembled in succession by applying, over the whole of the length, the end of one strip against the contiguous end of the preceding strip and by spot welding.

In accordance with the invention, the successive operations for forming the strip comprise: a first forming operation providing a double bend of the strip about two first transverse fold lines, a second forming operation providing a flat double bend of the strip about two new transverse fold lines disposed on each side of said first fold lines, so that the two end portions of the strip are parallel and connected together by an S profile portion, and a third forming operation providing a double bend of the strip on the same side as one of its end portions about two additional transverse fold lines, so as to bring the end portions of the strip substantially in the same plane.

It will be understood that, with the method of the invention, panels may be obtained comprising strips of all widths and all heights with the same tools.

It will also be understood that the method for forming the strips makes it possible when assembling same to accommodate the differences in dimensions due to the accumulation of the tolerances of the materials as well as the differences due to the different operations carried out.

During assembly of the strips, the space between the projecting portions of the successive strips may be adjusted at will, this space being 8 to 10 mm, or more, without modifying the method of manufacturing the strips.

The strips thus assembled in panels may be fastened blindly to uprights with a fastening system, which makes it possible to obtain a particularly pleasant appearance by aligning panels without visible intermediate posts.

For a better understanding of the manufacturing method of the invention, a preferred embodiment thereof will be described hereafter by way of non limitative example, with reference to the accompanying schematic drawings in which, FIG. 1 is a front view of a metal sheet strip used for putting the method of the invention into practice;

Figure 1:
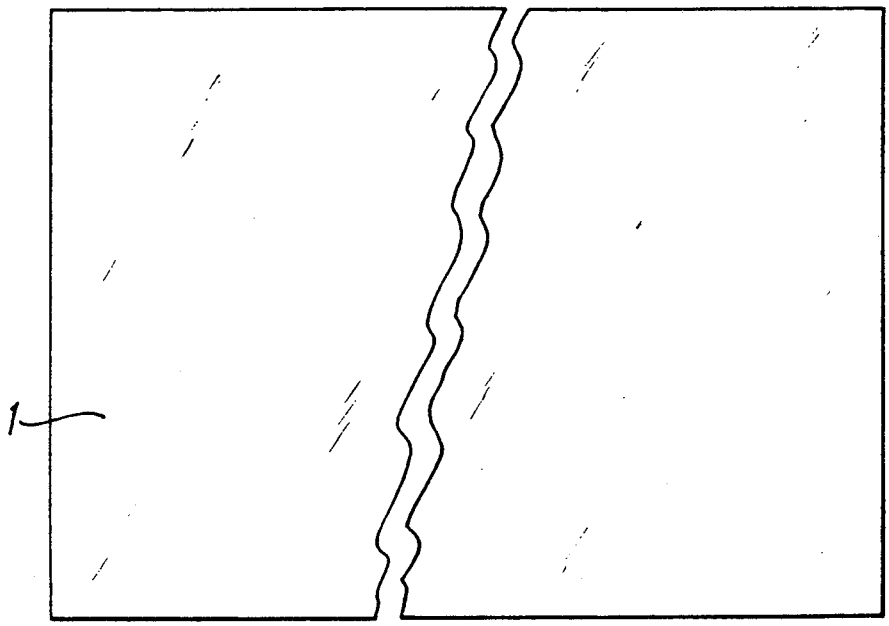
Figure 2:
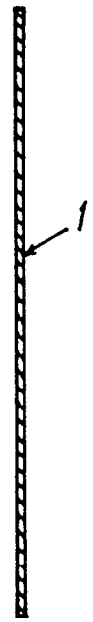
FIG. 2 is a cross section of the strip of FIG. 1.
Figure 3:
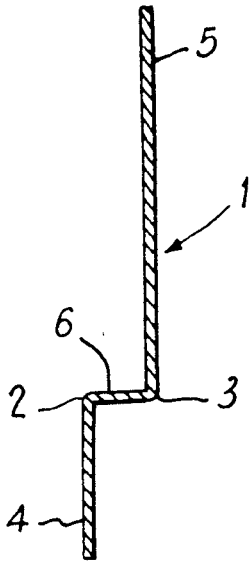
FIGS. 3 to 5 are cross sections of the strip of FIGS. 1 and 2, respectively after the first, second and third forming operations.

For manufacturing the display panels of the invention, identical metal sheet strips 1 are used, one of which has been shown in FIGS. 1 and 2, having a length which corresponds to that of the panel to be formed. The metal sheet strip 1 undergoes, in a first work station, a first operation which consists in a double bend about lines 2 and 3 so as to present, as shown in FIG. 3, two parallel end portions 4, 5 connected together by a portion 6 oriented perpendicularly thereto.

Figure 4:
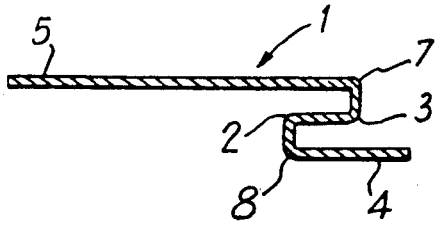

A second forming operation is then carried out in a second work station, during which the strip 1 is bent flat about lines 7, 8 so that, as shown in FIG. 4, its substantially parallel end portions 4, 5 are connected together by an intermediate S profile portion.

Figure 5:
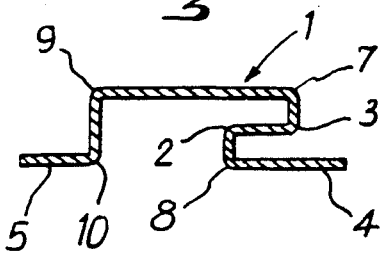

In a third forming station, the strip 1 then undergoes double bending close to its end portion 5, about lines 9, 10 so that its end portions 4, 5 are substantially in the same plane as can be seen in FIG. 5.

Figure 6:
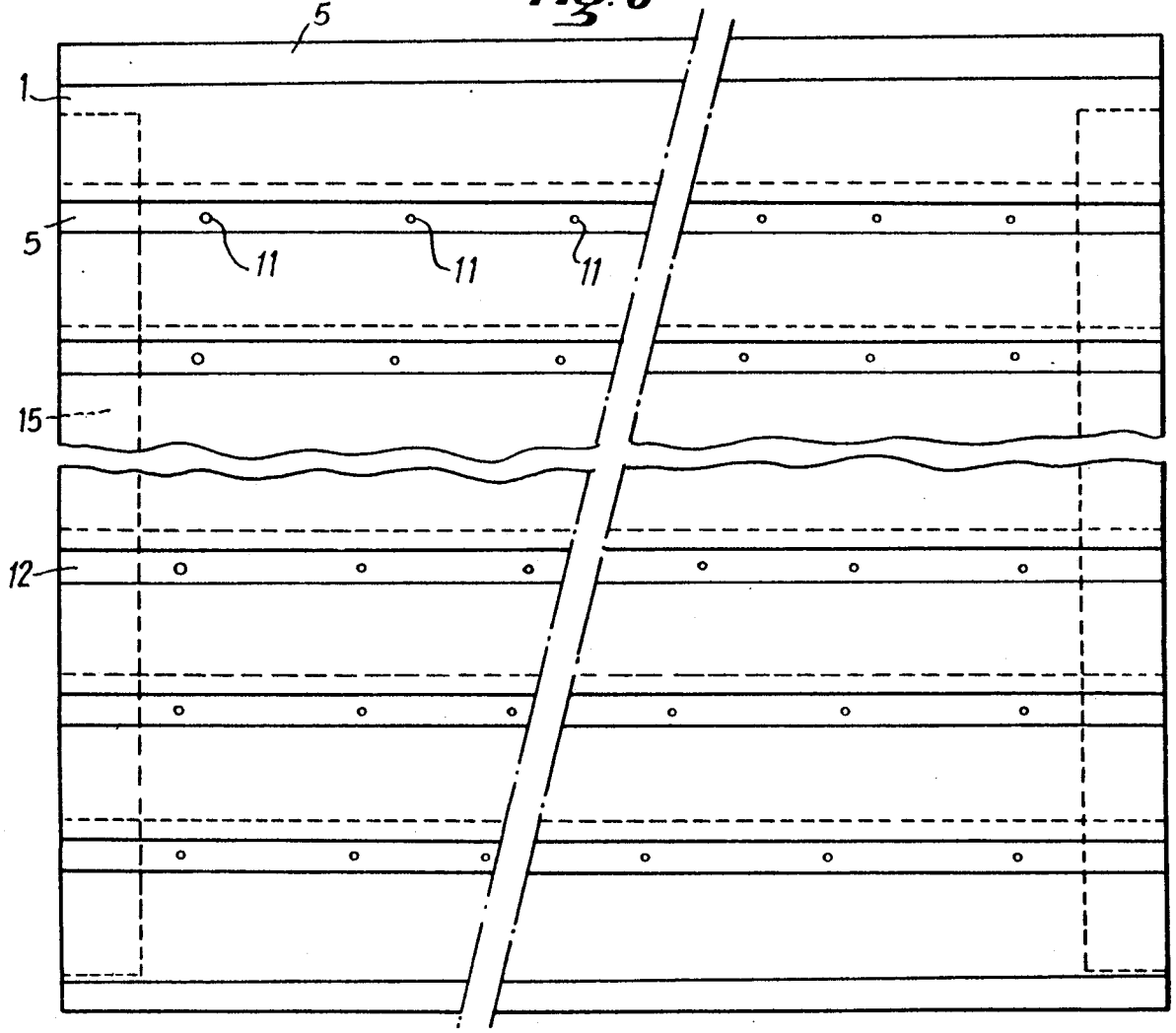
FIG. 6 is a front view of a panel obtained using the method of the invention, by assembling the strips of FIG. 5.
Figure 7:
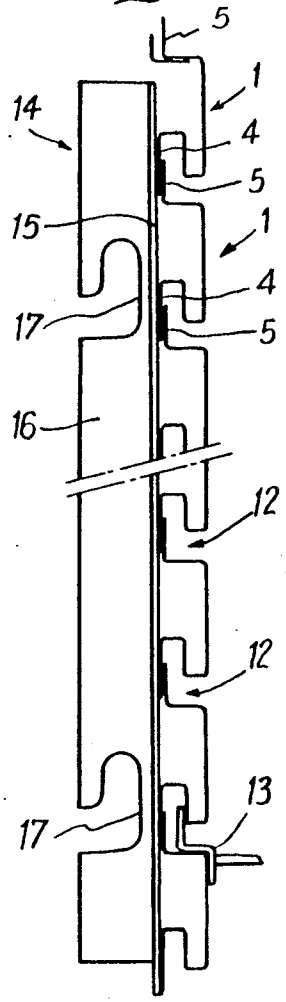
FIG. 7 is a profile view of the panel of FIG. 8.

The strips 1 thus formed are then assembled together as shown in FIGS. 6 and 7 by applying the end 4 of one strip against the end 5 of the preceding strip and joining the strips together over the whole of their length by spot welds 11. The space 12 left between the strips 1 during assembly and which forms grooves in which hook members 13 may be engaged for suspending objects to be displayed may for example be of the order of 8 to 10 mm.

To the panels, thus formed of a given number of strips 1 for example nine or thirteen strips, vertical uprights 14 are fixed in the form of angle irons. As can be seen in FIGS. 6 and 7, the rear face of the panel is welded to a flange 15 of upright 14, whereas the other flange 16 of the upright has cut-outs 17 designed for hooking on to wall supports.

After manufacture, the panel thus obtained is subjected to painting operations so as to have an agreeable appearance for use in all display positions.

Figure 8:
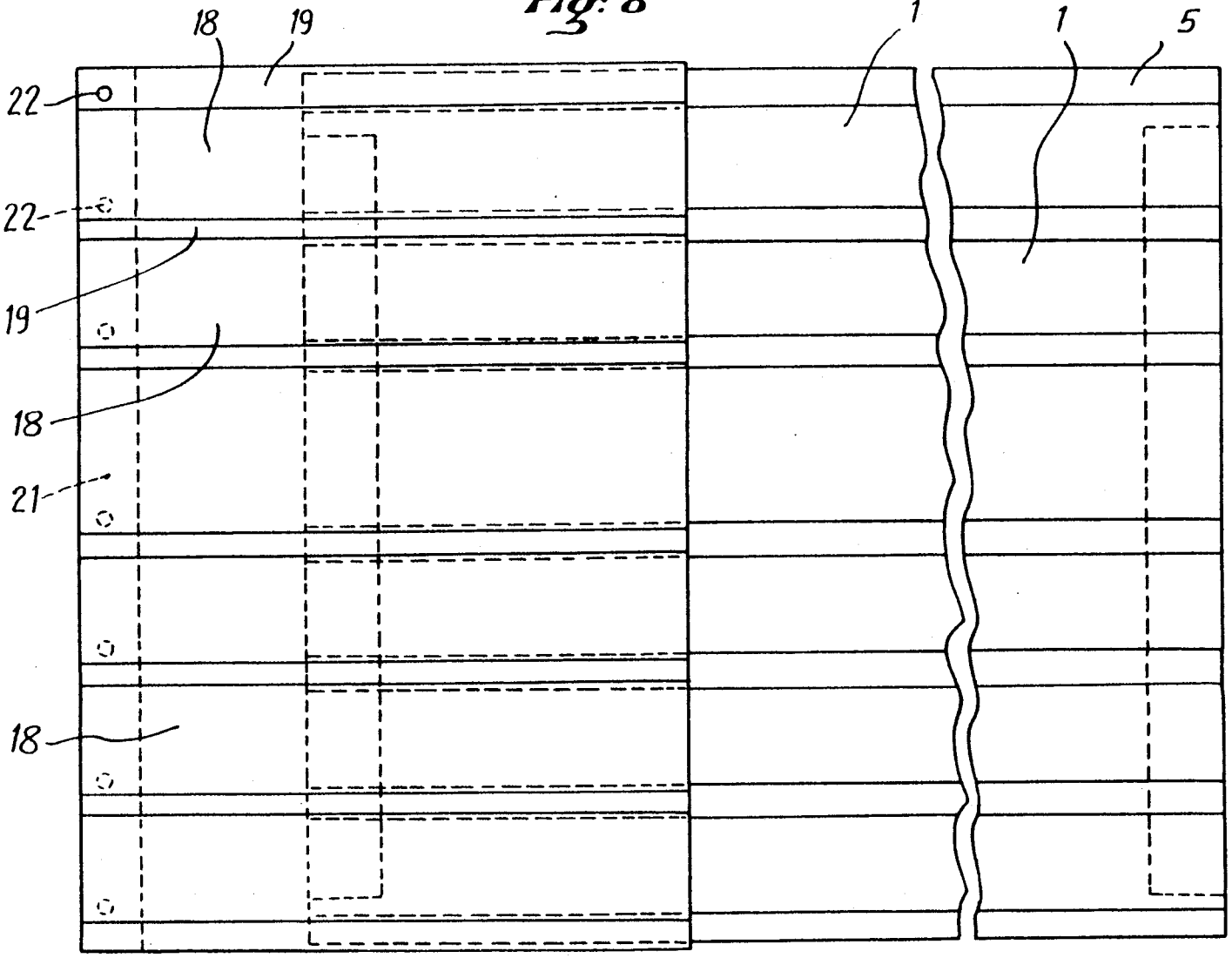
FIG. 8 is a front view corresponding to FIG. 6, in a particular application, permitting adjustable extension of the panel.
Figure 10:
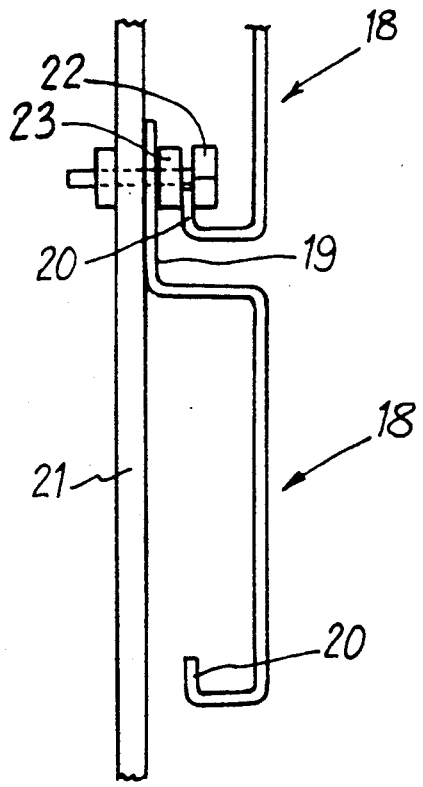
FIG. 10 is a vertical partial sectional view on a larger scale of a sliding strip serving for extension of the panel.
Figure 9:
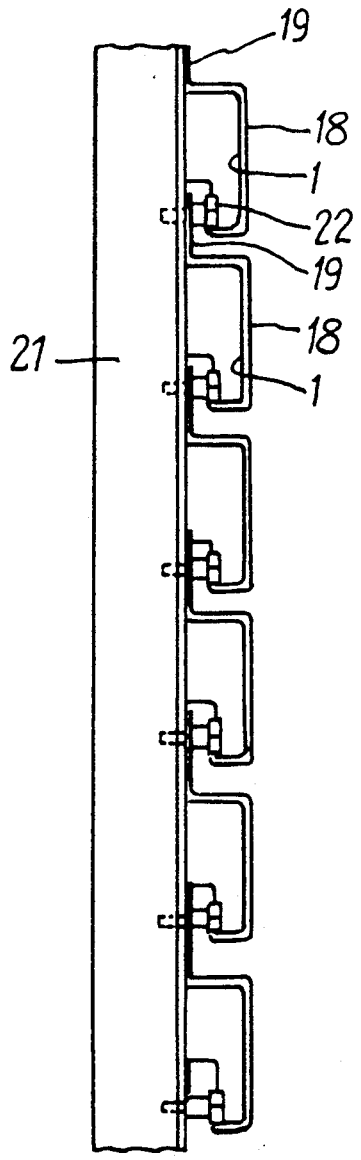
FIG. 9 is a partial profile view corresponding to FIG. 8.

The panels of the invention are generally manufactured in standard lengths so that, when the length of the space to be equipped is slightly greater than the length of the panel, a space remains free at the side of the panel after positioning thereof which is unsightly. To overcome this drawback, metal sheet strips are formed each having a profile in the form of a slide for sliding over the end portion of a strip of the panel, and which are intended to be fixed individually to a vertical upright at the end of the space to be filled. As can be seen in FIGS. 8 to 10, each of these strips 18 has an upturned U shaped portion ending at one end in a flange 19 turned outwardly and, at the other end, in an inwardly turned flange 20. For positioning, each strip 18 is engaged for sliding on a strip 1 of the panel and its end, which projects laterally with respect to the panel, is fixed to the upright 21 at the end of the space to be equipped. Such fixing is provided by a bolt 22 clamping the flange 19 of strip 18 against the upright 21. As can be seen in FIG. 10, bolt 22 serves at the same time for fixing the lower end of the preceding strip 18, by clamping the flange 20 of this strip against the head of the bolt 22 and a washer 23. FIG. 8 shows the result obtained when the successive strips 18 have been fixed.

The panels of the invention being intended generally to be associated with a base and a front piece, it will be understood that they may be telescopic so as to extend laterally when the panel itself undergoes a lateral extension in the way shown in FIGS. 8 to 10.

It will be understood that the above description has been given simply by way of example, without any limitative character and that constructional additions or modifications may be made without departing from the scope of the invention defined by the following claims.

I claim:

1. Method of manufacturing a support panel for the display of objects, comprising the steps of:

(a) cutting out identical metal sheet strips whose length corresponds to that of the panel to be formed, (b) subjecting each strip thus obtained to successive forming operations so as to give i a profile having a cross-section such that its ends along the length of the strips are disposed substantially in the same plane and separated from each other by an intermediate projecting portion which is connected to one of said ends by an S portion, and (c) assembling together the strips thus formed by applying, over the whole of the length, one end of one strip against the opposite end of the preceding strip and joining said strips by spot welding.

2. Method of manufacturing a support panel for the display of objects, comprising the steps of:

(a) cutting out identical metal sheet strips whose length corresponds to that of the panel to be formed, (b) subjecting each strip thus obtained to successive forming operations so as to give it a profile such that its ends are vertical and in a cross direction are disposed substantially in the same plane and separated from each other by an intermediate projecting portion which is connected to one of said ends by an S portion, said successive forming operations comprising:

(c) a first operation for forming a double bend of the strip about two first transverse fold lines, (d) a second operation for forming a double flat bend of the strip about two new transverse fold lines disposed on each side of the first fold lines so that the ends of the strip are parallel and connected together by an S profile portion, (e) a third operation for forming a double bend of the strip on the same side as one of its ends about two additional transverse fold lines so as to bring the two end of the strip substantially into the same plane, and (f) assembling together the strips thus formed by applying, over the whole of the length, one end of one strip against the opposite end of the preceding strip and by spot welding.

3. Method according to claim 1 wherein the panel obtained by the assembly of the strips is fixed by welding, at each of its longitudinal ends, to a vertical support upright.

4. Support panel for the display of objects, which comprises a succession of metal sheet strips each having vertical upper and lower ends substantially disposed in a same plane and an intermediate projecting portion, the vertical upper end of each metal sheet strip of the support panel being superimposed to the vertical lower end of the metal sheet strip just preceding it in the support panel and said superimposed upper and lower ends being secured together by spot welding, said assembled upper and lower ends defining between the projecting portions of the two metal sheet strips a groove for hooking on suspension elements.

5. Panel according to claim 4 wherein the projecting portion of each metal sheet strip is connected to one of the ends of this strip by an S profile portion.

6. Panel according to claim 4 which comprises, on its rear face, a vertical upright in the form of an angle iron fixed by welding to each longitudinal end of the panel.

7. Panel according to claim 6 wherein each vertical upright has, on one of its flanges, cut-outs for fastening it to a support.

8. Support panel for the display of objects which comprises a succession of metal sheet strips each having vertical upper and lower ends substantially disposed in a same plane and an intermediate projecting portion, the vertical upper end of each metal sheet strip of the support panel being superimposed to the vertical lower end of the metal sheet strip just preceding its in the support panel and said superimposed upper and lower ends being secured together by spot welding, said assembled upper and lower ends defining between the projecting portions of the two metal sheet strips a groove for hooking on suspension elements, and at least towards one end each metal sheet strip cooperating with an extension strip in the form of a slide which may slide on the metal sheet strip and is fixed individually, by its projecting end, to a vertical upright while forming a lateral extension of the panel between the end thereof and said upright.

9. Panel according to claim 8 wherein he extension strip is fixed on the upright by bolting an outwardly turned flange of the extension strip against said upright, the same bolt also serving for fixing an inwardly turned flange of the adjacent extension strip.

* * * * *